US012038228B2

(12) United States Patent
Kyriacou et al.

(10) Patent No.: US 12,038,228 B2
(45) Date of Patent: Jul. 16, 2024

(54) SMART ADJUSTABLE SHELVES FOR REFRIGERATOR APPLIANCES

(71) Applicant: Haier US Appliance Solutions, Inc., Wilmington, DE (US)

(72) Inventors: Stephanos Kyriacou, Louisville, KY (US); Michael Goodman Schroeder, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 138 days.

(21) Appl. No.: 17/875,704

(22) Filed: Jul. 28, 2022

(65) Prior Publication Data

US 2024/0035737 A1 Feb. 1, 2024

(51) Int. Cl.
*F25D 25/02* (2006.01)
*F25D 27/00* (2006.01)
*F25D 29/00* (2006.01)

(52) U.S. Cl.
CPC ..... *F25D 25/02* (2013.01); *F25D 27/005* (2013.01); *F25D 29/00* (2013.01); *F25D 29/003* (2013.01); *F25D 2500/02* (2013.01); *F25D 2500/04* (2013.01); *F25D 2500/06* (2013.01); *F25D 2700/06* (2013.01)

(58) Field of Classification Search
CPC ..... F25D 25/02; F25D 25/04; F25D 27/00; F25D 27/005; F25D 29/00; F25D 29/003; F25D 29/005; F25D 2500/02; F25D 2500/04; F25D 2500/06; F25D 2700/06; F25D 2600/00
See application file for complete search history.

(56) References Cited

U.S. PATENT DOCUMENTS

| | | | | |
|---|---|---|---|---|
| 7,840,286 | B2 | 11/2010 | Caldwell et al. | |
| 8,340,809 | B2 | 12/2012 | Chadbourne | |
| 8,485,618 | B2 * | 7/2013 | Benz | F24C 15/16 312/408 |
| 9,784,497 | B2 | 10/2017 | Wang et al. | |
| 9,913,535 | B2 * | 3/2018 | Lin | A47B 57/00 |
| 2020/0132361 | A1 * | 4/2020 | Carlotto | F25D 11/02 |
| 2021/0088270 | A1 * | 3/2021 | Allgeier | A47B 51/00 |

(Continued)

FOREIGN PATENT DOCUMENTS

| | | | | |
|---|---|---|---|---|
| CN | 108548358 A | * | 9/2018 | F25D 11/00 |
| CN | 108592475 A | * | 9/2018 | |
| CN | 109813045 A | * | 5/2019 | |

(Continued)

*Primary Examiner* — Andrew Roersma
(74) *Attorney, Agent, or Firm* — Dority & Manning, P.A.

(57) ABSTRACT

A refrigerator is provided having a shelf assembly and a controller. The shelf assembly may include a shelf and a drive mechanism configured to move the shelf in at least a vertical direction. The refrigerator also includes an object detection system configured to detect an article placed adjacent to the shelf. The controller may be configured to determine the proximity of an article and the shelf using the object detection system, detect a shelf moving event, and move the shelf in response to the shelf moving event. The shelf moving event may be based, at least in part, on the proximity of the article and the shelf. The controller may also be configured to move the shelf in response to detecting a flow restriction above or below the shelf.

17 Claims, 4 Drawing Sheets

(56) References Cited

U.S. PATENT DOCUMENTS

| | | | | | |
|---|---|---|---|---|---|
| 2021/0180857 | A1* | 6/2021 | Thayyullathil | ..... | F25D 29/00 |

FOREIGN PATENT DOCUMENTS

| | | | | | |
|---|---|---|---|---|---|
| CN | 111121363 | A | * | 5/2020 | |
| CN | 111649529 | A | * | 9/2020 | ..... F25D 25/028 |
| CN | 111649531 | A | * | 9/2020 | |
| CN | 111664650 | A | * | 9/2020 | |
| CN | 113140073 | A | * | 7/2021 | ..... G06K 9/00664 |
| CN | 114322399 | A | * | 4/2022 | |
| DE | 102011079196 | A1 | * | 1/2013 | ..... F24C 15/16 |
| JP | 2021148352 | A | * | 9/2021 | |
| KR | 1020190048633 | A | * | 5/2019 | |
| WO | WO2016087083 | A1 | | 6/2016 | |
| WO | WO-2022262234 | A1 | * | 12/2022 | |

* cited by examiner

SMART ADJUSTABLE SHELVES FOR REFRIGERATOR APPLIANCES

FIELD OF THE INVENTION

The present subject matter relates generally to household appliances, and more particularly to refrigerator appliances.

BACKGROUND OF THE INVENTION

Refrigerator appliances include a cabinet, define an inner chamber, and include at least one door for allowing selective access to the inner chamber. Refrigerators generally include shelves to hold articles for refrigeration with in the inner chamber. In some refrigerators, the shelves are adjustable to allow for different sized articles to be placed thereon.

Challenges exist in that it can be cumbersome to adjust shelves. Shelves within a refrigerator may need to be empty or have no articles placed thereon prior to adjustment to the placement of shelves within the inner chamber. Additionally, when inner chamber is filled with multiple articles, air flow between shelves may become non-uniform or diminished. Air flow is generally important in maintaining proper refrigeration temperatures within inner chamber. Diminished air flow or non-uniform air flow between shelves may lower the efficiency and cooling abilities throughout the refrigerator appliance.

Accordingly, a refrigerator appliance that improves air flow between shelves in the refrigerator would be beneficial. Additionally or alternatively, improvements to adjusting shelves within refrigerator appliances would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator is provided. The refrigerator may have a lateral direction, a vertical direction, and a transverse direction The refrigerator may include a cabinet, a door, a shelf assembly, an object detection system, and a controller. The cabinet may define an inner chamber and a threshold into the inner chamber. The door may allow selective entry into the inner chamber. The shelf assembly may include a shelf and a drive mechanism. The drive mechanism may be configured to move the shelf in at least the vertical direction. The shelf assembly may be located within the inner chamber. The object detection system may be configured to detect an article placed adjacent to the shelf of the shelf assembly. The controller may be in operative communication with the shelf assembly and the object detection system. The controller may be configured to determine a proximity of the article and the shelf using the object detection system, detect a shelf moving event based at least in part on the proximity of the article and the shelf, and operate the drive mechanism to move the shelf to adjust a space above or below the shelf in response to the shelf moving event.

In another exemplary aspect of the present disclosure, a shelf assembly is provided. The shelf assembly may be configured to be located within an inner chamber of a household appliance. The household appliance may have a lateral direction, a vertical direction, and a transverse direction. The shelf assembly may include a shelf, a drive mechanism, an object detection system, and a controller. The drive mechanism may be configured to move the shelf in at least the vertical direction. The object detection system may be configured to detect an article placed adjacent to the shelf of the shelf assembly. The controller may be in operative communication with the shelf assembly and the object detection system. The controller may be configured to determine a proximity of the article and the shelf using the object detection system, detect a flow restriction above or below the shelf in the shelf assembly, and operate the drive mechanism to move the shelf to generate more space above or below the shelf in response to the flow restriction.

In another exemplary aspect of the present disclosure, a shelf assembly positioning method for a refrigerator having a shelf assembly and an object detection system is provided. The shelf assembly may have a shelf and a drive mechanism. The shelf assembly may be configured to house an article on the shelf assembly. The shelf assembly positioning method may include the steps of determining a proximity of the article and the shelf using the object detection system, detecting a shelf moving event based at least in part on the proximity of the article and the shelf, and operating the drive mechanism to move the shelf to generate more space above or below the shelf in response to the shelf moving event.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Use of the same of similar reference numerals in the figures denotes the same or similar features unless the context indicates otherwise.

DETAILED DESCRIPTION

Figure 1:
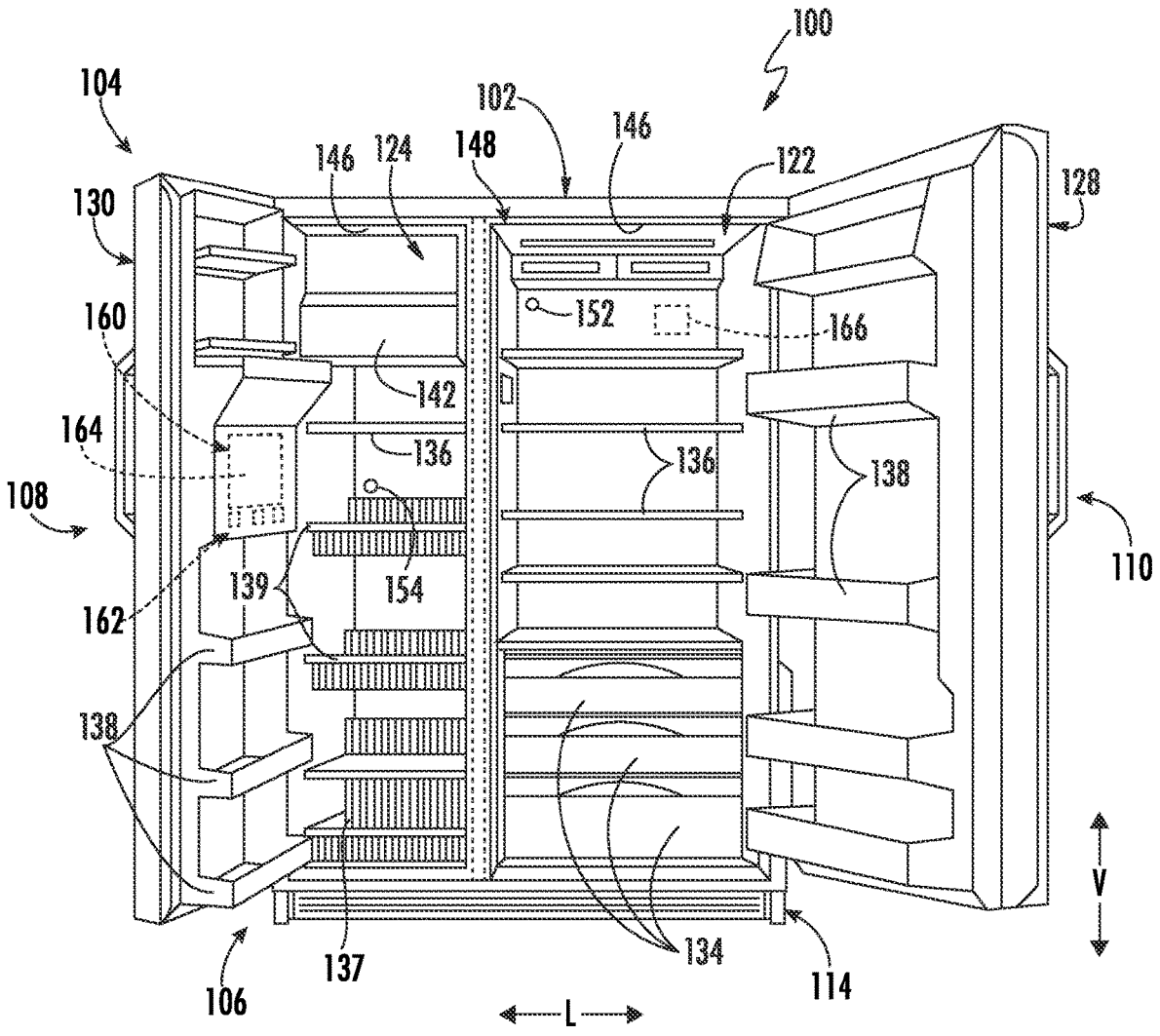
FIG. 1 provides a perspective view of an exemplary refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. Terms such as "inner" and "outer" refer to relative directions with respect to the interior and exterior of the appliance, and in particular the chamber(s) defined therein. For example, "inner" or "inward" refers to the direction towards the interior of the appliance. Terms such as "left," "right," "front," "back," "top," or "bottom" are used with reference to the perspective of a user accessing the appliance (e.g., when the door is in the closed position). For example, a user stands in front of the appliance to open a door and reaches into the internal chamber(s) to access items therein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise, or counter-clockwise, with the vertical direction V).

Aspects of the present subject matter advantageously provide a refrigerator appliance having a shelf assembly that moves with a drive mechanism, an object detection system, and a controller configured to detect an article coming into the refrigerator appliance and move at least one shelf within the shelf assembly to better accommodate the article. In some examples, the shelf assembly and controller are configured to adjust the shelves to adjust space between shelves, including shelves with articles placed thereon, to increase or improve air flow within the refrigerator. Advantageously, placing articles in the refrigerator appliance may be made easier, as tall, or bulky items may more readily be placed without manual movement of shelves within the shelf assembly. Further, temperatures within the refrigerator appliance may fluctuate less due to improved air flow according to embodiments described herein.

FIG. 1 provides a front view of a representative refrigerator appliance 100 according to an example embodiment of the present disclosure. More specifically, for illustrative purposes, the present disclosure is described in the context of a refrigerator appliance 100 having a construction as shown and described further below. As used herein, refrigerator appliance 100 includes appliances such as a refrigerator/freezer combination, side-by-side, bottom mount, compact, and any other style or model of refrigerator appliance. Accordingly, other configurations including multiple and different styled compartments may be used with refrigerator appliance 100, it being understood that the configuration shown in FIG. 1 is provided by way of example only.

Figure 2:
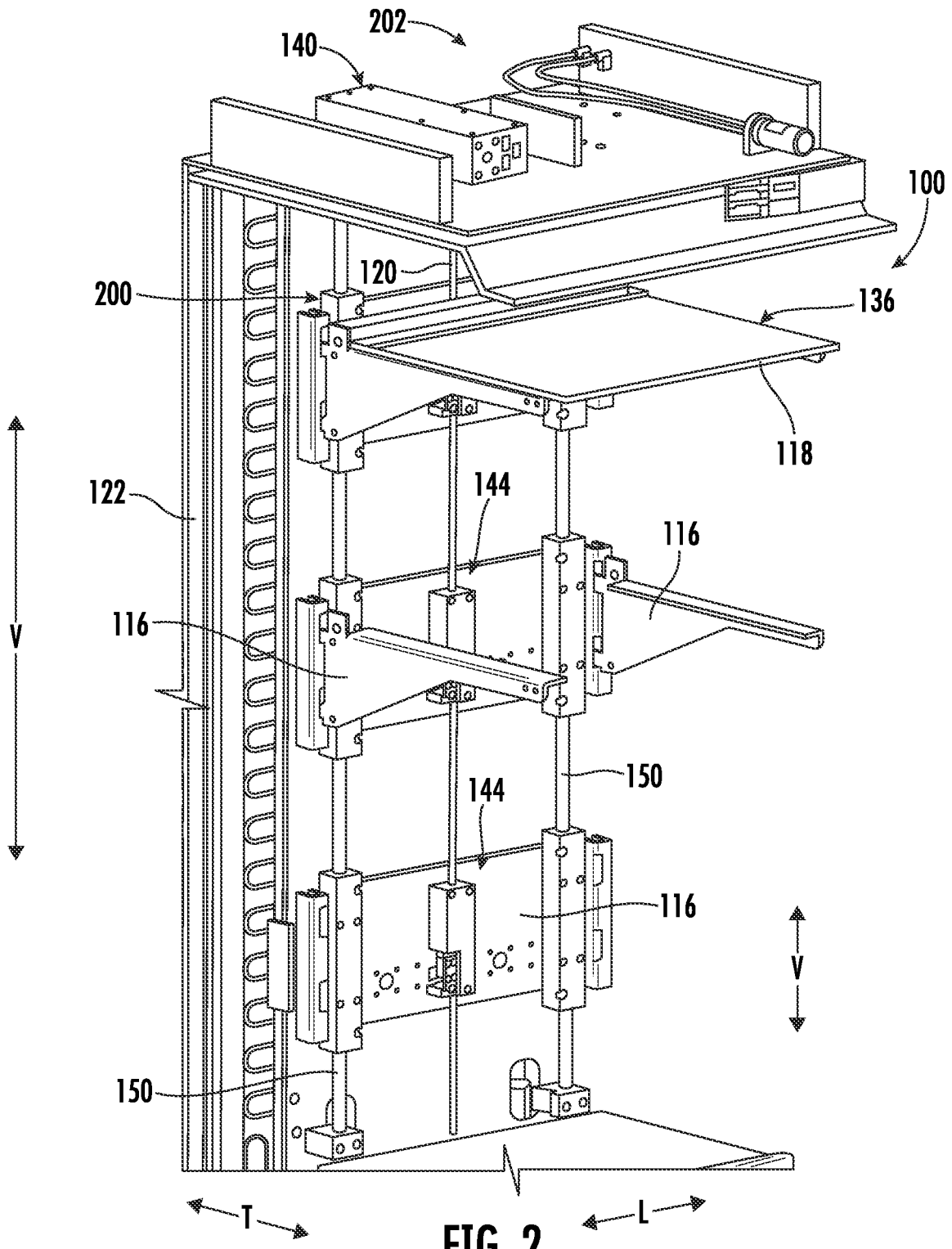
FIG. 2 provides a perspective view of an exemplary shelf assembly according to exemplary embodiments of the present disclosure.

Referring now to the figures, an example appliance 100 will be described in accordance with example aspects of the present subject matter. Specifically, FIG. 1 provides a perspective view of an example refrigerator appliance 100 with doors 128, 130 in the open position, and FIG. 2 provides a perspective view of inner chamber 122 and shelf assembly 200 of refrigerator appliance 100. As illustrated, refrigerator appliance 100 generally defines a vertical direction V, a lateral direction L, and a transverse direction T that are mutually perpendicular and form an orthogonal coordinate system.

According to example embodiments, refrigerator appliance 100 includes a cabinet 102 that is generally configured for containing and/or supporting various components of refrigerator appliance 100 and which may also define one or more internal chambers or compartments of refrigerator appliance 100. In this regard, as used herein, the terms "cabinet," "housing," and the like are generally intended to refer to an outer frame or support structure for refrigerator appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of refrigerator appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top portion 104 and a bottom portion 106 along the vertical direction V, between a first side portion 108 (e.g., the left side when viewed from the front as in FIG. 1) and a second side portion 110 (e.g., the right side when viewed from the front as in FIG. 1) along the lateral direction L, and between a front portion 112 and a rear portion 114 along the transverse direction T.

Cabinet 102 defines inner chambers 122, 124 for receipt of food items for storage. In particular, cabinet 102 defines inner, fresh food chamber 122 positioned at or adjacent right portion 110 of cabinet 102 and inner, freezer chamber 124 arranged at or adjacent left portion 108 of cabinet 102. In this embodiment, fresh food chamber 122 and freezer chamber 124 are arranged side-by-side within the cabinet 102. As such, refrigerator appliance 100 is generally referred to as a side-by-side refrigerator. It is recognized, however, that the benefits of the present disclosure apply to other types and styles of refrigerator appliances such as, e.g., a top mount refrigerator appliance, a bottom mount refrigerator appliance, or a single door refrigerator appliance. Moreover, aspects of the present subject matter may be applied to other appliances as well. Consequently, the description set forth herein is for illustrative purposes only and is not intended to be limiting in any aspect to any particular appliance or configuration.

Refrigerator doors 128, 130 are rotatably hinged to an edge of cabinet 102 for allowing selective entry or access to inner chambers 122, 124. In general, refrigerator doors 128, 130 form a seal over a threshold 148 of cabinet 102. Threshold 148 may lie in a plane with vertical and lateral directions, proximate to the position of the doors 128, 130 in the closed position. Threshold 148 may generally be located at a front opening area of inner chambers 122, 124. In this regard, a user may place items within fresh food chamber 122 through threshold 148 when refrigerator door 128 is open, crossing threshold 148. User may then close refrigerator door 128 to facilitate climate control. Refrigerator doors 128, 130 are shown in the open configuration in FIG. 1. One skilled in the art will appreciate that other chamber and door configurations are possible and within the scope of the present invention.

FIG. 1 provides a perspective view of refrigerator appliance 100 shown with refrigerator doors 128, 130 in the open position. As shown in FIG. 1, various storage components are mounted within fresh food chamber 122 and within freezer chamber 124 to facilitate storage of food items therein as will be understood by those skilled in the art. In particular, the storage components may include pans 134 and shelves 136. Each of these storage components are configured for receipt of food items (e.g., beverages and/or solid food items) and may assist with organizing such food items. As shown, pans 134 slide into a receiving space in fresh food chamber 122. As illustrated, door bins 138 may be mounted on refrigerator doors 128, 130. It should be appreciated that the illustrated storage components are used only for the purpose of explanation and that other storage components may be used and may have different sizes, shapes, and configurations.

Optionally, shelves 136 and wire baskets 137 may be provided in freezer chamber 124. Additionally or alternatively, an ice maker 142 may be provided in freezer chamber 124. Refrigerator doors 128, 130 allow selective access to inner chambers 122, 124 of refrigerator appliance, respectively.

Referring again to FIG. 1, refrigerator appliance 100 may include a control panel 160 that may represent a general-purpose Input/Output ("GPIO") device or functional block for refrigerator appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads. Additionally, appliance 100 may include a display 164, such as a digital or analog display device generally configured to provide visual feedback regarding the operation of refrigerator appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Refrigerator appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of refrigerator appliance 100. For example, signals generated by controller 166 may operate refrigerator appliance 100, including any or all system components, subsystems, or interconnected devices, in response to the position of user input devices 162 and other control commands. Control panel 160 and other components of refrigerator appliance 100 may be in communication with controller 166 via, for example, one or more signal lines or shared communication busses. In this manner, Input/Output ("I/O") signals may be routed between controller 166 and various operational components of refrigerator appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 166 may be operable to execute programming instructions or micro-control code associated with an operating cycle of appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods as disclosed herein. For example, in some embodiments, methods disclosed herein may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases and/or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of refrigerator appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In some embodiments, one or more temperature sensors are provided to measure the temperature in the fresh food chamber 122 and the temperature in the freezer chamber 124. For example, a first temperature sensor 152 may be disposed in the fresh food chamber 122 and may measure the temperature in the fresh food chamber 122. A second temperature sensor 154 may be disposed in the freezer chamber 124 and may measure the temperature in the freezer chamber 124. This temperature information can be provided (e.g., to controller 166 for use in operating refrigerator 100). These temperature measurements may be taken intermittently or continuously during operation of the appliance or execution of a control system.

Figure 3:
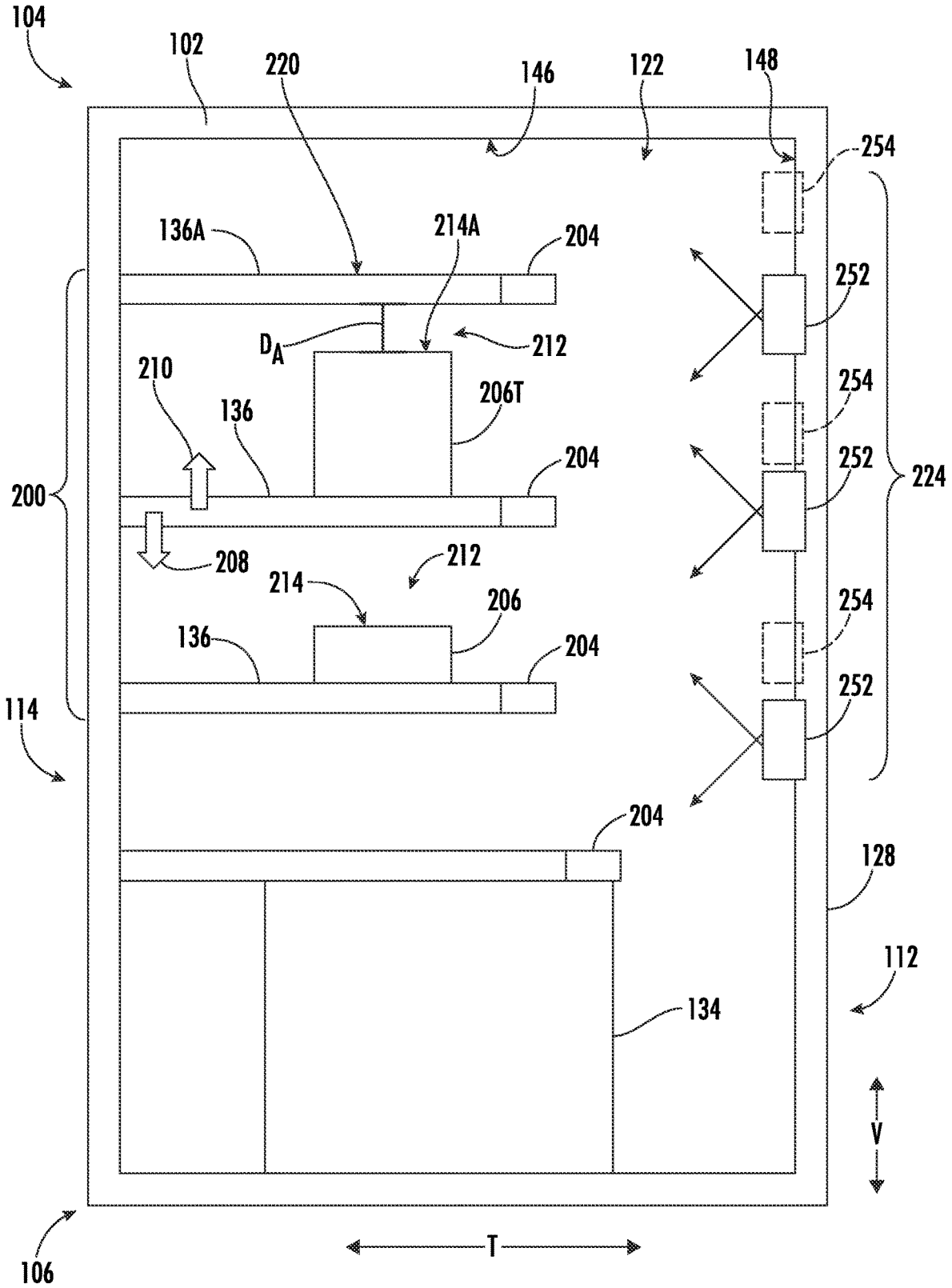
FIG. 3 provides a side, cross sectional view of the exemplary refrigerator appliance of FIG. 1.

Turning to FIGS. 2 and 3, FIG. 2 is a partial perspective view of a shelf assembly 200 of refrigerator appliance 100. FIG. 3 is a schematic, cross sectional side view of refrigerator appliance 100. While described in greater detail below in the context of refrigerator appliance 100, it will be understood that shelf assembly 200 may be used in any suitable appliance in alternative example embodiments. For example, shelf assembly 200 may be used in a top-mount refrigerator appliance, a bottom-mount refrigerator appliance, a stand-alone freezer appliance, etc. Furthermore, the remaining description describes inner chamber 122, or fresh food chamber 122 of refrigerated portion of refrigerator appliance 100, but the systems and methods described herein could also be applied to freezer chamber 124, or another freezer or refrigerator chamber, and description of inner chamber 122 is not intended to be limiting to refrigerated chambers only, but to refrigerator chambers, freezer chambers, or combination refrigerator-freezer chambers within a refrigerator appliance. As discussed in greater detail below, shelf assembly 200 includes features for motorized movement of shelves 136, such as shelves 136. In particular, shelf assembly 200 may be operable to selectively move one or more of shelves 136 with a drive mechanism 202, such as s single motor 140, as shown in FIG. 2.

Shelf assembly 200 includes at least one shelf 136 and a drive mechanism 202. The drive mechanism 202 is configured to move the at least one shelf in at least the vertical direction V. The shelf assembly 200 is located within inner chamber of cabinet 102. Drive mechanism 202 may include a motor 140, as shown in FIG. 2, but may also be a mechanical actuator, or other equivalent device including a hydraulic piston or other device as would be understood. Drive mechanism 202 may include or work with clutches 144, lead screw 120, tracks 150, to move shelf assembly 200, as shown in FIG. 2. Although an example shelf assembly and drive mechanism are described and illustrated herein to facilitate discussion of aspects of the present subject matter, any other suitable shelf assembly may be used, and any other suitable drive mechanism may be used to facilitate shelf movement. For example, an exemplary shelf assembly and drive mechanism are shown in U.S. Pat. No. 11,125,491, which is hereby incorporated by reference in its entirety for all purposes.

Various mechanisms may drive movement of shelf assembly 200 with drive mechanism 202, including the example shown in FIG. 2. In FIG. 2, shelf assembly 200 includes a lead screw 120. Lead screw 120 is mounted within fresh food chamber 122 such that lead screw 120 is rotatable. Drive mechanism 202 (such as motor 140 in FIG. 2) coupled to lead screw 120, and drive mechanism 202 may be operable to rotate lead screw 120. Drive mechanism 202 may be positioned at a top or bottom of lead screw 120 (shown at top of lead screw 120 in FIG. 2). By rotating lead screw 120, drive mechanism 202 may move one or more of shelves 136, e.g., along the vertical direction V, within fresh food chamber 122.

Each shelf 136 may include a shelf support or bracket 116. Shelf support 116 may be mounted on a track 150, e.g., that restrains movement of shelf support 116 to along the vertical direction V. Thus, shelf support 116 may translate along the vertical direction V in fresh food chamber 122 (or freezer chamber 124 in alternative example embodiments). Each shelf 136 may also include a panel 118 positioned on shelf support 116. Panel 118 may be removable from shelf support 116, e.g., to facilitate cleaning of panel 118. Various food items or articles 206 (as shown in FIG. 3) may be stored on panels 118. In FIG. 2, each shelf 136 includes two shelf supports 116. In alternative example embodiments, each shelf 136 may include one, three, or more shelf supports 116.

Shelf assembly 200 also includes a plurality of clutches 144. Each clutch 144 may mounted to a respective shelf support 116. Each clutch 144 may also be selectively opened and closed to connect the respective shelf support 116 to lead screw 120. When the clutch 144 is engaged, or closed, the respective shelf support 116 is coupled to lead screw 120 such that rotation of lead screw 120 by motor 140 moves the respective shelf support 116 along the vertical direction V. Conversely, when clutch 144 is opened, or disengaged, the respective shelf support 116 is disconnected from lead screw 120 such that rotation of lead screw 120 by motor 140 does not move the respective shelf support 116 along the vertical direction V. Thus, clutches 144 may regulate vertical movement of shelves 136.

As shown in FIG. 3, shelf assembly 200 may include at least one light 204 attached to at least one shelf 136. In some embodiments, at least one light 204 may be attached to an edge or other portion of each shelf 136 in shelf assembly 200. Controller 166 may be in operative communication with the at least one light 204 of shelf assembly 200. Lights 204 may be configured to activate to indicate a preferred position for an article 206. For example, light 204 on a shelf 136 may be activated by controller 166 to indicate the shelf 136 is a preferred position for an article 206 detected. In some embodiments, each shelf 136 in shelf assembly 200 may be attached to a light 204. Though four lights 204 are shown in FIG. 3, more or fewer lights 204 may be used for different embodiments.

Additionally or alternatively, at least one light 204 may be configured to activate during movement of a shelf 136 by the drive mechanism 202. Light activation may provide additional safety, as a user may be given a visual alert that a particular shelf 136 is moving or may aid in quicker detection of proper placement of articles 206 within inner chamber 122, as will be discussed herein. Article detection and light indication of shelves 136 will be discussed in more detail below.

In FIG. 2, shelf assembly 200 includes three shelves 136. It will be understood that this is provided by way of example only. In alternative example embodiments, shelf assembly 200 may include one, two, four, or more shelves 136. One, two, or all three of clutches 144 in FIG. 2 may be closed to move the respective shelf support 116 along the vertical direction V by rotating lead screw 120 with motor 140. Conversely, one, two, or all three of clutches 144 in FIG. 2 may be opened to keep the respective shelf support 116 at a fixed position along the vertical direction V despite rotation of lead screw 120 with motor 140. In alternative embodiments, refrigerator 100 may have one, two, three, or more clutches 144. As may be seen from the above, one, two, or all three of shelves 136 may be vertically moved with motor 140 by selectively closing the respective clutch 144. Thus, only one motor 140 may be used to move only one shelf 136 or to move two/three of shelves 136 simultaneously.

Refrigerator appliance 100 may further include an object detection system 224. Object detection system 224 may be configured to detect an article 206 placed adjacent to the shelf 136 of the shelf assembly 200. Object detection system 224 may further be capable of detecting when an article 206 crosses the threshold 148 into the inner chamber 122. In some examples, object detection system 224 may be able to detect articles 206 placed on shelves 136, including dimensions of those items and spaces (e.g., space 212 shown in FIG. 3 between article 206 and high shelf 136A).

Object detection system 224 may include at least one camera 252 as shown in FIG. 3. Though three cameras 252 are shown in FIG. 3, systems described herein may include fewer or more cameras 252 in object detection system 224. Multiple cameras 252 may be valuable to determine dimensions or articles 206 located in different positions with in refrigerator appliance 100. Cameras 252 may be placed in various positions within inner chamber 122 to detect articles 206 or shelves 136 contained therein.

Generally, camera 252 may be any type of device suitable for capturing at least one image or video. As an example, camera 252 may be a video camera or a digital camera with an electronic image sensor [e.g., a charge coupled device (CCD) or a CMOS sensor]. Although the term "image" is used herein, it should be appreciated that according to exemplary embodiments, camera 252 may take any suitable number or sequence of two-dimensional images, videos, or other visual representations of appliance 100 or components of appliance 100. For example, the one or more images may include a video feed, or a series of sequential static images obtained by camera 252 that may be transmitted to controller 166 (e.g., as a data signal) for analysis or other manipulation. In some embodiments, camera 252 transmits images or video feed directly to a user device (e.g., through wireless signal). Optionally, one or more light sources (not shown) may be provided with or adjacent to the camera 252. During use, camera 252 may take images or video feed in coordination with the light sources such as to obtain higher quality or truer-to-color images of appliance 100 or items therein or thereon.

Additionally or alternatively, object detection system 224 may include at least one motion sensor 254. Motion sensors 254 may be configured to generate data that controller 166 may use to generate positional grid of inner chamber 122, the positional grid including the location of shelves 136 and articles 206 placed thereon or articles 206 crossing threshold 148 of inner chamber 122. For example, the object detection system 224 may include at least one time of flight sensor 254, as shown in FIG. 3. Though time of flight sensors 254 are shown in FIG. 3, other motion sensors 254 may be used in some embodiments. According to exemplary embodiments, motion sensors 254 may be any suitable optical, acoustic, electromagnetic, or other sensors suitable for detecting motion within a space or mapping an enclosed space (e.g., including establishing a baseline as described herein). For example, these motion sensors may include proximity sensors, time of flight sensors, motion sensors, optical sensors, etc.

In general, each motion sensor 254 may establish a baseline for comparison, e.g., associated with a reading when no motion is detected. Thus the system of motion sensors 254 may form a grid or array (e.g., a positional grid as described herein or other map of positions within chamber 122) from which motion may be detected. Each motion sensor 254 may be used to estimate the distance from the moving object or determine a proximity of that object to the camera 252. The object in motion may be virtualized into a two-dimensional position by analyzing and comparing feedback from some or all sensors 254. For example, if two motion sensors detect motion, then object is likely between those sensors 254 along the vertical direction V. It should be appreciated that weighted averaging may be used to obtain an accurate prediction of the location where motion is occurring. In addition, it should be appreciated that the sensor configuration and analysis methods are only exemplary and may vary while remaining within the scope of the present subject matter.

Referring now specifically to FIG. 3, an exemplary configuration of motion sensors 254 will be described. Specifically, as shown, the one or more motion sensors 254 may be spaced apart along the vertical direction V and the lateral direction L to define a positional grid for detecting motion at one or more locations. In this regard, for example, motion sensors 254 may be spaced apart in a manner similar to cameras 252, e.g., along the sides and/or top of fresh food chamber 122. In this manner, controller 156 may determine the location or locations where motion is occurring based on feedback from motion sensors 254.

Though both cameras 252 and motion sensors 254 are shown in FIG. 3, embodiments described herein may include just cameras 252 or just motion sensors 254 or a combination of both, depending on the embodiment.

Figure 4:
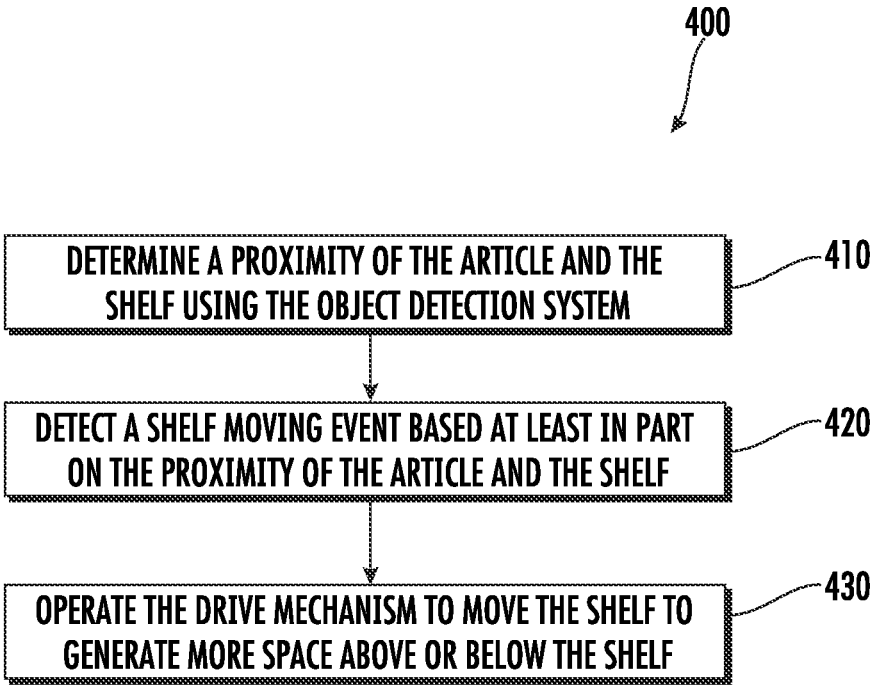
FIG. 4 provides a flow chart of a shelf moving event method according to exemplary embodiments of the present disclosure.

Referring now to FIG. 4, various methods (e.g., method 400) may be provided for use with appliance 100 in accordance with the present disclosure. In some embodiments, all, or some of the various steps of the method(s) may be performed by a suitable controller (e.g., controller 166). Thus, controller 166 may be configured to direct such a method. During such methods, controller 166 may receive inputs and transmit outputs from various other portions of the appliance 100. For example, the controller 166 may send signals to and receive signals from shelf assembly 200 including drive mechanism 202, object detection mechanism, including at least one camera 252 or at least one motion sensor 254. The present methods may advantageously determine article 206 position within inner chamber 122 and provide opportunities for storage without manual replacement of shelves 136. For instance, the disclosed methods may advantageously automatically move shelves 136 to improve airflow within a closed refrigerator, or automatically move shelves 136 to accommodate an article 206 being placed therein. Such may be particularly useful if the article 206 is tall, or the article 206 has a height greater than a current distance above a shelf 136.

At step 410, the method 400 includes determining a proximity of the article 206 and the shelf 136 using the object detection system 224. For example, the controller 166 may use data provided by the object detection system 224 to determine a relative position of the shelf 136 and a proximity of the article 206 to the shelf 136. In some embodiments, step 410 may further include determining at least one dimension of the article 206 using the object detection system 224. For example, data may be received from the object detection system 224. The controller 166 may analyze the data from the object detection system 224 to determine a proximity of the article 206 or a dimension of the article 206. For example, the data may be analyzed to determine a height of the article 206 in vertical direction V. The position of the shelf 136 within the inner chamber 122 may also be determined from the analysis of the data from the object detection system 224.

For example, the controller 166 may be configured to receive at least one image from the at least one camera 252. In some embodiments, the controller 166 may further be configured to identify at least one article 206 in the inner chamber 122 from the at least one image received from the at least one camera 252. For instance, images from the at least one camera 252 of the object detection system 224 may be analyzed to determine the relative proximity of the article 206, the shelf 136, or at least one dimension of the article 206 (e.g., an article dimension in the vertical direction).

According to exemplary embodiments of the present subject matter, method 400 includes, obtaining one or more images of inner chamber 122. Although the term "image" is used herein, it should be appreciated that according to exemplary embodiments, camera 252 may take any suitable number or sequence of two-dimensional images, videos, or other visual representations of inner chamber 122 including shelf assembly 200 and any articles that pass threshold 148 into inner chamber 122. For example, the one or more images may include a video feed or series of sequential static images obtained by camera 252 that may be transmitted to the controller 166 (e.g., as a data signal) for analysis or other manipulation. These obtained images may vary in number, frequency, angle, field-of-view, resolution, detail, etc.

Controller 166 may be configured to analyze one or more images to identify at least one shelf 136, a shelf moving event, or at least one article 206, including relative positions and dimensions thereof (and as described herein). According to exemplary embodiments, this image analysis may use any suitable image processing technique, image recognition process, etc. As used herein, the terms "image analysis" and the like may be used generally to refer to any suitable method of observation, analysis, image decomposition, feature extraction, image classification, etc. of one or more images, videos, or other visual representations of an object. As explained in more detail below, this image analysis may include the implementation of image processing techniques, image recognition techniques, or any suitable combination thereof. In this regard, the image analysis may use any suitable image analysis software or algorithm to monitor inner chamber constantly or periodically 122. It should be appreciated that this image analysis or processing may be performed locally (e.g., by controller 166) or remotely (e.g., by offloading image data to a remote server or network).

Specifically, the analysis of the one or more images may include implementation an image processing algorithm. As used herein, the terms "image processing" and the like are generally intended to refer to any suitable methods or algorithms for analyzing images that do not rely on artificial intelligence or machine learning techniques (e.g., in contrast to the machine learning image recognition processes described below). For example, the image processing algorithm may rely on image differentiation, e.g., such as a pixel-by-pixel comparison of two sequential images. This comparison may help identify substantial differences between the sequentially obtained images, e.g., to identify movement, the presence of a particular object, the existence of a certain condition, etc. For example, one or more reference images may be obtained when a particular condition exists, and these references images may be stored for future comparison with images obtained during appliance operation. Similarities and/or differences between the reference image and the obtained image may be used to extract useful information for improving appliance performance.

According to exemplary embodiments, image processing may include blur detection algorithms that are generally intended to compute, measure, or otherwise determine the amount of blur in an image. For example, these blur detection algorithms may rely on focus measure operators, the Fast Fourier Transform along with examination of the frequency distributions, determining the variance of a Laplacian operator, or any other methods of blur detection known by those having ordinary skill in the art. In addition, or alternatively, the image processing algorithms may use other suitable techniques for recognizing or identifying items or objects, such as edge matching or detection, divide-and-conquer searching, greyscale matching, histograms of receptive field responses, or another suitable routine (e.g., executed at the controller 166 based on one or more captured images from one or more cameras). Other image processing techniques are possible and within the scope of the present subject matter. The processing algorithm may further include measures for isolating or eliminating noise in the image comparison, e.g., due to image resolution, data transmission errors, inconsistent lighting, or other imaging errors. By eliminating such noise, the image processing algorithms may improve accurate object detection, avoid erroneous object detection, and isolate the important object, region, or pattern within an image.

In addition to the image processing techniques described above, the image analysis may include utilizing artificial intelligence ("AI"), such as a machine learning image recognition process, a neural network classification module, any other suitable artificial intelligence (AI) technique, and/or any other suitable image analysis techniques, examples of which will be described in more detail below. Moreover, each of the exemplary image analysis or evaluation processes described below may be used independently, collectively, or interchangeably to extract detailed information regarding the images being analyzed to facilitate performance of one or more methods described herein or to otherwise improve appliance operation. According to exemplary embodiments, any suitable number and combination of image processing, image recognition, or other image analysis techniques may be used to obtain an accurate analysis of the obtained images.

In this regard, the image recognition process may use any suitable artificial intelligence technique, for example, any suitable machine learning technique, or for example, any suitable deep learning technique. According to an exemplary embodiment, the image recognition process may include the implementation of a form of image recognition called region based convolutional neural network ("R-CNN") image recognition. Generally speaking, R-CNN may include taking an input image and extracting region proposals that include a potential object or region of an image. In this regard, a "region proposal" may be one or more regions in an image that could belong to a particular object or may include adjacent regions that share common pixel characteristics. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like, as opposed to a regular R-CNN architecture. For example, mask R-CNN may be based on fast R-CNN which is slightly different than R-CNN. For example, R-CNN first applies a convolutional neural network ("CNN") and then allocates it to zone recommendations on the covn5 property map instead of the initially split into zone recommendations. In addition, according to exemplary embodiments, standard CNN may be used to obtain, identify, or detect any other qualitative or quantitative data related to one or more objects or regions within the one or more images. In addition, a K-means algorithm may be used.

According to still other embodiments, the image recognition process may use any other suitable neural network process while remaining within the scope of the present subject matter. For example, the step of analyzing the one or more images may include using a deep belief network ("DBN") image recognition process. A DBN image recognition process may generally include stacking many individual unsupervised networks that use each network's hidden layer as the input for the next layer. According to still other embodiments, the step of analyzing one or more images may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence analysis techniques, and combinations of the above described or other known methods may be used while remaining within the scope of the present subject matter.

In addition, it should be appreciated that various transfer techniques may be used but use of such techniques is not required. If using transfer techniques learning, a neural network architecture may be pretrained such as VGG16/VGG19/ResNet50 with a public dataset then the last layer may be retrained with an appliance specific dataset. In addition, or alternatively, the image recognition process may include detection of certain conditions based on comparison of initial conditions, may rely on image subtraction techniques, image stacking techniques, image concatenation, etc. For example, the subtracted image may be used to train a neural network with multiple classes for future comparison and image classification.

It should be appreciated that the machine learning image recognition models may be actively trained by the appliance with new images, may be supplied with training data from the manufacturer or from another remote source, or may be trained in any other suitable manner. For example, according to exemplary embodiments, this image recognition process relies at least in part on a neural network trained with a plurality of images of the appliance in different configurations, experiencing different conditions, or being interacted with in different manners. This training data may be stored locally or remotely and may be communicated to a remote server for training other appliances and models. According to exemplary embodiments, it should be appreciated that the machine learning models may include supervised and/or unsupervised models and methods. In this regard, for example, supervised machine learning methods (e.g., such as targeted machine learning) may help identify problems, anomalies, or other occurrences which have been identified and trained into the model. By contrast, unsupervised machine learning methods may be used to detect clusters of potential failures, similarities among data, event patterns, abnormal concentrations of a phenomenon, etc.

It should be appreciated that image processing and machine learning image recognition processes may be used together to facilitate improved image analysis, object detection, or to extract other useful qualitative or quantitative data or information from the one or more images that may be used to improve the operation or performance of the appliance. Indeed, the methods described herein may use any or all of these techniques interchangeably to improve image analysis process and facilitate improved appliance performance and consumer satisfaction. The image processing algorithms and machine learning image recognition processes described herein are only exemplary and are not intended to limit the scope of the present subject matter in any manner.

Additionally or alternatively, controller 166 may be configured to receive data from the plurality of motion sensors 254. In some embodiments, data from the at plurality of motion sensors 254, such as a time of flight sensors 254, may be used by the controller 166 to generate positional grid of the inner chamber 122 from the data received from the plurality of motion sensors 254. The positional grid may show or depict the relative positions of the shelves 136 of the shelf assembly 200, articles 206 placed on the shelves 136 of the shelf assembly 200, or the relative position, proximity, or dimensions of the article 206 in proximity to the shelf 136. Such analysis of the positional grid of the motion sensors 254 may follow an analysis similar to the analysis of the images of camera 252 as previously described, or as otherwise understood.

At step 420, the method 400 includes detecting a shelf moving event based at least in part on the proximity of the article 206 and the shelf 136. Generally, a shelf moving event may be a condition, event, or occurrence that indicates that shelf movement may be desirable to facilitate item storage or to improve airflow within inner chamber 122. Various shelf moving events will now be described including detecting a flow restriction and detecting an article 206 crossing the threshold 148 into the inner chamber 122.

The shelf moving event may be detecting a flow restriction above or below the shelf 136 in the shelf assembly 200. Generally, a flow restriction may be detected as a lack of space between an article 206 and a shelf 136 adjacent, above, or next to the article 206. For example, the controller 166 may measure the distance DA between an article top 214 and a shelf 136 directly above it, such as article top 214A of article 206T and high shelf 136A in FIG. 3. The distance DA may be the measured distance between the article top 214A and the high shelf 136A. In some embodiments, when distance DA is determined to be less than a preset distance by the controller 166, a shelf moving event is detected.

In some embodiments, distances between multiple articles 206 and multiple shelves 136 may be calculated, and if the difference between at least one of the distances calculated is less than a preset value, the shelf moving event is detected.

In some embodiments, the method 400 further includes, at step 420, detecting the distance DA between the article 206 and an upper shelf 136 directly above the article 206 in the vertical direction V. For example, controller 166 may receive data from object detection system 224 and analyze it to detect the distance between the article 206 and the shelf 136. Further, the method 400 at step 420 includes calculating a minimum distance between each inner chamber 122 and each proximate shelf 136 in the shelf assembly 200 directly above each article 206 and automatically adjusting a position of the upper shelf 136 within the inner chamber 122 to adjust the distance between the article 206 and the upper shelf 136 to be at least the uniform minimum distance.

Additionally or alternatively, the controller 166 may be configured to find a tallest article 206T placed on each shelf 136 of the shelf assembly 200 and calculate the distance between the tallest article 206T and the shelf 136 or an inner chamber top panel 146 for each identified article 206. In other words, controller 166 may be configured to measure a height of article 206T. If the different distances are determined to be different from one another, that may further be shelf moving event detecting a flow restriction. This calculation may be performed each time the door is closed, or each time articles 206 are detected as crossing the threshold 148 in or out of the inner chamber 122 and the door 128 is closed.

In some embodiments, the method 400 at step 420 further includes detecting a distance between the article 206 of an upper shelf 136 directly above the article 206 in the vertical direction. For example, controller 166 may receive data from object detection system 224 and analyze it to detect the distance between the article 206 and the shelf 136. Further, the method 400 at step 420 includes calculating a minimum distance between each inner chamber 122 and each proximate shelf 136 in the shelf assembly 200 directly above each article 206 and automatically adjusting a position of the upper shelf 136 within the inner chamber 122 to adjust the distance DA between the article 206 and the high shelf 136A to be at least a uniform minimum distance.

The shelf moving event may be detecting the article 206 crossing the threshold 148 into the inner chamber 122. For example, when a user goes to put an article 206 into the refrigerator appliance 100, and the article 206 crosses the threshold 148 into the inner chamber 122. The controller 166 may be configured to detect the article 206 crossing the threshold 148 into the inner chamber 122. The controller 166 may further be configured to detect an article 206 in the threshold 148 of the inner chamber 122 by analyzing data received from the object detection system 224. For example, object detection system 224 may send data for analysis at regular intervals, or when the images are detected as changing (e.g., due to movement within the inner chamber 122). The controller 166 receives this data, analyzes it, and in the analysis detects the article 206 in the threshold 148 of the inner chamber 122. For example, the controller 166 may be able to detect an article 206 crossing the threshold 148 into the inner chamber 122. Images from camera 252 or infrared data from motion sensors 254 (e.g., time of flight sensors 254), may be received by controller 166 and used or analyzed to detect article 206 in threshold 148.

In some embodiments, the method 400 may include measuring a height of article 206 detected crossing threshold 148. For example, controller 166 may be configured to receive data from the object detection system 224 (as described herein including from at least one camera 252 or at least one motion sensor 254), analyze the data to detect article 206 crossing threshold 148, detect the vertical edges of article 206 (a top and bottom of the article 206), and measure the height of article 206 (e.g., in vertical direction V) from the data received.

In some embodiments, the method 400 may include measuring a vertical dimension, a lateral dimension, and a transverse dimension of the article 206 detected as crossing the threshold 148 into the inner chamber 122. For instance, controller 166 may be configured to receive data from the object detection system 224 (as described herein including from at least one camera 252 or at least one motion sensor 254), analyze the data to detect the article 206 crossing the threshold 148, detect the edges or sides of the article 206, and use the data to measure the vertical dimension, the lateral dimension, and the transverse dimension of the article 206.

Additionally or alternatively, method 400 may include identifying at least one shelf 136 with an open area large enough to house the article 206 in the lateral dimension and the transverse dimension. For example, the controller 166 may identify at least one shelf 136 with an open area large enough to house the article 206 in the lateral direction and the transverse direction. The controller 166 may use received data from the object detection system 224 to identify the at least one shelf 136. The open area may be a portion of the shelf 136 that is empty or devoid of an article 206 when the identification takes place. The lateral dimension and transverse dimension may be used to determine whether the shelf 136 has an open area large enough for the article 206, and the vertical dimension may be addressed by movement of the shelf 136, if deemed appropriate. As used herein, the lateral dimension may be a measurement in the lateral direction L, the vertical dimension may be a measurement in the vertical direction V, and the transverse dimension may be a measurement in the transverse direction T.

The shelf moving event may be receiving information that an article is soon to be placed in refrigerator appliance 100. For example, controller 166 may receive a notification of a purchase of at least one article to be placed in the inner chamber 122 of refrigerator appliance 100 by the user. The notification may include dimensions or rough dimensions of at least one article purchased at the store by the user that the user intends to place in the refrigerator appliance 100. The controller may further be configured to move at least one shelf 136 of shelf assembly 200 to accommodate the shelf configuration in the inner chamber 122 to the at least one article the user intends to place in the refrigerator appliance 100. Controller 166 may receive the notification by a remote user device, or by a remote server through a network. Movement of at least one shelf 136 may be performed prior to the at least one article crossing the threshold 148. Advantageously, shelves in the shelf assembly may move to accommodate groceries while the user is on their way home from the grocery store, which may allow a user to save time putting away articles from the store.

In some embodiments, the method 400 may further include activating light 204 attached to shelf 136 identified with an open area large enough to house article 206 in the lateral dimension and the transverse dimension, activation of light 204 may indicate a preferred position for article 206 detected. Controller 166 may be configured to activate light 204 on shelf 136 identified to visually notify a user where article 206 would be best placed within the refrigerator.

At step 430, the method 400 may include operating drive mechanism 202 to move shelf 136 to adjust the space above or below shelf 136. This may be done in response to the shelf moving event. For example, controller 166 may be configured to operate drive mechanism 202 to move shelf 136 in the vertical direction to adjust the position of shelf 136 within inner chamber 122 of refrigerator 100.

In some examples, such as when the shelf moving event is detecting a flow restriction, the method 400 at step 430 may include operating drive mechanism 202 to move shelf 136 to generate more space above or below shelf 136 in response to the flow restriction. Controller 166, once determining a flow restriction, may move one or more shelves 136 in shelf assembly 200 to generate either a minimum distance between shelves 136 and articles 206 placed in inner chamber 122 (e.g., the minimum distance being between an article 206 and a shelf 136 directly above article 206 in the vertical direction V), or to generate a similar distance between articles 206 in inner chamber 122 and shelves 136 of shelf assembly 200. The similar distance may be an average of the distances calculated by controller 166 using the data from object detection system 224. Advantageously, air flow within refrigerator appliance 100 may be improved by assuring similar or a minimum distance around articles 206 in the vertical direction V within inner chamber 122. Further, this may provide a way to improve air flow without multiple temperature sensors in the inner chamber 122, or without measuring airflow throughout the inner chamber 122.

In some embodiments, such as when the shelf moving event is article 206 crossing threshold 148 into inner chamber 122, the method further includes adjusting the height of shelf 136 to provide a void above shelf 136 exceeding the height of article 206 detected. In some embodiments, high shelf 136A may be identified as having an open area 220 and may be moved in the vertical direction V to provide a void exceeding the height of article 206 detected as crossing threshold 148.

The method 400 may further include adjusting the height of shelf 136 (as shown by arrows 208 and 210 in FIG. 3) to increase the vertical dimension of the open area to exceed the vertical dimension of article 206 detected. In other words, once article 206 is detected and shelf 136 best suited for article 206 identified, controller 166 may be configured to move at least one shelf 136 in shelf assembly 200 to create a void or increase the open area identified for article 206 to exceed the vertical dimension of article 206 detected. Article 206 may then be placed on shelf 136 identified by the user who moved article 206 across threshold 148.

In some embodiments, the method 400 includes activating light 204 on shelf 136 identified to indicate a preferred position for article 206 detected. Thus, the user may readily be informed of the identified preferred position being created for article 206 that crosses threshold 148. Additionally or alternatively, the method may include activating light 204 during the movement of shelf 136 by drive mechanism 202. In other words, shelf 136 moving by drive mechanism 202 may be illuminated by light 204 during movement of shelf 136. Such may serve as an informative and safety system, alerting the user that shelf 136 is moving.

In some embodiments, controller 166 may further move at least one shelf 136 in shelf assembly 200 in response to receiving a user input to move a shelf 136. For example, the refrigerator 100 may include shelf movement controls (not shown) for a user to direct movement of shelves 136 to a desired configuration.

Embodiments described herein may include an arrangement in a refrigerator wherein multiple cameras and/or multiple time of flight sensors may be employed in the interior of the door or walls of the inner chamber to determine a minimum gap below each shelf of the shelf assembly within the refrigerator. The system may automatically move or adjust the shelves vertically to optimize airflow and improve accessibility to all items based on the input from the sensors. In some embodiments, when paired with a camera system, the shelves may move to accept an especially tall item as a user moves it into the threshold for observation. The sensors provide feedback to avoid shelves from moving against height of items on the shelf when adjusting manually. The controller may include an algorithm to recognize shelf edges (e.g., a front shelf edge and/or a side shelf edge). The shelves may begin to adjust when an item or article is observed to be coming towards the threshold with or without prompting. Further, the vertical dimension of the article may also be connected, e.g., by way of a remote network, to grocery store purchases and the controller may move the shelves upon notification of purchase of articles by the user at the grocery store (e.g., while the user is on their way home from the grocery store). Shelf or backlighting may be used to illuminate a shelf that is moving or about to move or to highlight where a tall item will fit best. Cameras or time of flight (ToF) sensors detect maximum size of an item in the threshold, the position of each shelf, and respective gaps below each shelf. Shelves may be moved accordingly in preparation for the item if it is too tall to fit in a pre-movement shelf configuration. Thus, accommodations for large items may be made within the refrigerator without a user having to manually adjust the shelves of the shelf assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator having a lateral direction, a vertical direction, and a transverse direction, the refrigerator comprising:

a cabinet defining an inner chamber and a threshold into the inner chamber;

a door allowing selective entry into the inner chamber;

a shelf assembly comprising a shelf and a drive mechanism, the drive mechanism configured to move the shelf in at least the vertical direction, the shelf assembly located within the inner chamber;

an object detection system configured to detect an article placed adjacent to the shelf of the shelf assembly; and a controller in operative communication with the shelf assembly and the object detection system, the controller configured to:

determine a proximity of the article and the shelf using the object detection system;

detect a shelf moving event based at least in part on the proximity of the article and the shelf, wherein the shelf moving event includes detecting the article crossing into the threshold into the inner chamber;

measure a vertical dimension, a lateral dimension, and a transverse dimension of the article;

identify at least one shelf with an open area large enough to house the article the lateral dimension and the transverse dimension; and operate the drive mechanism to move the at least one shelf to adjust a space above or below the at least one shelf in response to the shelf moving event.

2. The refrigerator of claim 1, wherein the object detection system further comprises a plurality of motion sensors, and wherein the controller is further configured to:

receive data from the plurality of motion sensors, and generate a positional grid of the inner chamber from the data received from the plurality of motion sensors.

3. The refrigerator of claim 1, wherein the object detection system further comprises at least one camera, and wherein the controller is further configured to:

receive at least one image from the at least one camera, and identify at least one article in the inner chamber from the at least one image received from the at least one camera.

4. The refrigerator of claim 1, wherein the shelf moving event is detecting a flow restriction above or below the at least one shelf in the shelf assembly.

5. The refrigerator of claim 1, wherein the controller is further configured to detect the article in the threshold by analyzing data received from the object detection system.

6. The refrigerator of claim 1, the object detection system further comprising at least one time of flight sensor, the controller further configured to detect the article in the threshold by use of data received by the at least one time of flight sensor.

7. The refrigerator of claim 1, the controller further configured to measure a height of the article detected crossing the threshold and adjust the height of the shelf to provide a void above the shelf exceeding the height of the article detected.

8. The refrigerator of claim 7, wherein the controller is further configured to:

adjust the height of the at least one shelf to increase the vertical dimension of the open area to exceed the vertical dimension of the article detected.

9. The refrigerator of claim 8, wherein the shelf assembly further comprises at least one light attached to the at least one shelf, and wherein the controller is further configured to activate the light to indicate a preferred position for the article detected.

10. The refrigerator of claim 1, wherein the shelf assembly further comprises at least one light attached to the at least one shelf, and wherein the controller is configured activate the light during movement of the at least one shelf by the drive mechanism.

11. The refrigerator of claim 1, wherein the drive mechanism is further configured to move the shelf assembly by receipt of user input.

12. The refrigerator of claim 1, the controller further configured to:

detect a distance between the article and an upper shelf directly above the article in the vertical direction, calculate a uniform minimum distance between each article in the inner chamber and each proximate shelf in the shelf assembly directly above each article, and automatically adjust a position of the upper shelf within the inner chamber to adjust the distance between the article and the upper shelf to be at least the uniform minimum distance.

13. A shelf assembly configured to be located within an inner chamber of a household appliance, the household appliance having a lateral direction, a vertical direction, and a transverse direction, the shelf assembly comprising:

a shelf;

a drive mechanism, the drive mechanism configured to move the shelf in at least the vertical direction;

an object detection system configured to detect an article placed adjacent to the shelf of the shelf assembly; and a controller in operative communication with the shelf assembly and the object detection system, the controller configured to:

determine a proximity of the article and the shelf using the object detection system;

detect a flow restriction above or below the shelf in the shelf assembly, wherein detecting the flow restriction comprises measuring a vertical dimension, a lateral dimension, and a transverse dimension of the article and identifying the shelf with an open area large enough to house the article the lateral dimension and the transverse dimension; and operate the drive mechanism to move the shelf to generate more space above or below the shelf in response to the flow restriction.

14. The shelf assembly of claim 13, wherein the object detection system further comprises a plurality of motion sensors, and wherein the controller is further configured to:

receive data from the plurality of motion sensors, and generate a positional grid of the inner chamber from the data received from the plurality of motion sensors.

15. The shelf assembly of claim 13, wherein the object detection system further comprises at least one camera, and wherein the controller is further configured to:

receive at least one image from the at least one camera, and identify at least one article in the inner chamber from the at least one image received from the at least one camera.

16. A shelf assembly positioning method for a refrigerator having a shelf assembly with a shelf and a drive mechanism, and an object detection system, and configured to house an article on the shelf assembly, the shelf assembly positioning method comprising the steps of:

determining a proximity of the article and the shelf using the object detection system;

detecting a shelf moving event based at least in part on the proximity of the article and the shelf, wherein the shelf moving event includes detecting the article crossing into the threshold into the inner chamber;

measuring a vertical dimension, a lateral dimension, and a transverse dimension of the article;

identify the shelf with an open area large enough to house the article the lateral dimension and the transverse dimension; and operating the drive mechanism to move the shelf to generate more space above or below the shelf in response to the shelf moving event.

17. The shelf assembly positioning method of claim 16, further comprising activating a light located on the shelf to indicate a preferred position for the article.

* * * * *